US008294374B2

(12) United States Patent
Colak et al.

(10) Patent No.: US 8,294,374 B2
(45) Date of Patent: Oct. 23, 2012

(54) SYSTEMS AND METHODS FOR COPYING LIGHTING CONDITIONS USING LIGHT-WAVE IDENTIFICATION

(75) Inventors: Sel Brian Colak, Eindhoven (NL); Paulus Henricus Antonius Damink, Eindhoven (NL); Lorenzo Feri, Eindhoven (NL); Johan Paul Marie Gerard Linnartz, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 571 days.

(21) Appl. No.: 12/299,226

(22) PCT Filed: Apr. 24, 2007

(86) PCT No.: PCT/IB2007/051504

§ 371 (c)(1),
(2), (4) Date: Jan. 5, 2009

(87) PCT Pub. No.: WO2007/125477

PCT Pub. Date: Nov. 8, 2007

(65) Prior Publication Data

US 2009/0184648 A1 Jul. 23, 2009

(30) Foreign Application Priority Data

May 3, 2006 (EP) ..... 06113411

(51) Int. Cl.

| | |
|---|---|
| ***H05B 37/02*** | (2006.01) |
| ***H05B 39/04*** | (2006.01) |
| ***H05B 41/36*** | (2006.01) |
| ***F21V 9/00*** | (2006.01) |
| ***F21V 21/04*** | (2006.01) |

(52) U.S. Cl. ..... 315/158; 315/151; 315/291; 362/231; 362/276

(58) Field of Classification Search ..... 315/151, 315/158, 291; 700/28; 356/402
See application file for complete search history.

(56) References Cited

U.S. PATENT DOCUMENTS

| | | | | |
|---|---|---|---|---|
| 2002/0145041 | A1 | 10/2002 | Muthu et al. | |
| 2003/0057887 | A1 | 5/2003 | Dowling et al. | |
| 2005/0030744 | A1 | 2/2005 | Ducharme et al. | |
| 2009/0267524 | A1 * | 10/2009 | Draaijer et al. | 315/153 |
| 2010/0188004 | A1 * | 7/2010 | Baggen et al. | 315/209 R |
| 2010/0231363 | A1 * | 9/2010 | Knibbe | 340/286.02 |
| 2010/0244746 | A1 * | 9/2010 | Van De Sluis et al. | 315/312 |

(Continued)

FOREIGN PATENT DOCUMENTS

JP 2004213986 A1 7/2004

(Continued)

*Primary Examiner* — Shawki Ismail
*Assistant Examiner* — Dylan White
(74) *Attorney, Agent, or Firm* — John F. Salazar; Mark L. Beloborodov

(57) ABSTRACT

A lighting system includes a first and a second controllable light sources generating, respectively, a first and a second lights; a first detector configured to receive at least a portion of the first light and measure at least one attribute thereof in a first predetermined location proximate to the first controllable light source; a memory configured to store at least one of a specification of the second controllable light source and at least one operating parameter of the first controllable light source. The system also includes a processor configured to receive the at least one attribute of the first light, and to control the second controllable light source to generate the second light having an attribute that substantially matches the attribute of the first light in a predetermined second location.

19 Claims, 2 Drawing Sheets

U.S. PATENT DOCUMENTS

| | | | | |
|---|---|---|---|---|
| 2010/0301776 | A1* | 12/2010 | Feri et al. | 315/312 |
| 2011/0044701 | A1* | 2/2011 | Schenk et al. | 398/183 |

FOREIGN PATENT DOCUMENTS

| | | | |
|---|---|---|---|
| JP | 2005019000 | A | 1/2005 |
| WO | 0213490 | A2 | 2/2002 |
| WO | 0247438 | A2 | 6/2002 |
| WO | 02082283 | A2 | 10/2002 |
| WO | 02082863 | A1 | 10/2002 |
| WO | 2004057927 | A1 | 7/2004 |
| WO | 2006111934 | A1 | 10/2006 |
| WO | WO 2006111934 | * | 10/2006 |

* cited by examiner

SYSTEMS AND METHODS FOR COPYING LIGHTING CONDITIONS USING LIGHT-WAVE IDENTIFICATION

This application is a national stage application under 35 U.S.C. §371 of International Application No. PCT/IB2007/051504 filed on Apr. 24, 2007 and published in the English language on Nov. 8, 2007 as International Publication No. WO/2007/125477, which claims priority to European Application No. 06113411.0 filed on May 3, 2006, all of which are hereby incorporated herein by reference.

The present invention relates to systems and methods for copying light conditions in one location and pasting or providing similar light conditions in another location using a database including specification of controlled light sources.

The role of electronic control in illumination applications is rapidly growing. This is especially true with the introduction of solid state lighting LED sources. Such advances increase the complexity of lighting controls, particularly where various light attributes are controllable to select and provide desired lighting conditions. For example, it is desirable for a user to easily set various light attributes, such as the intensity as well as the color, hue and saturation of a light source(s), to provide a desired illumination of one area, and to duplicate such an illumination in another area.

U.S. Patent Application Publication 2002/0145041 A1 to Muthu et al., which is incorporated herein by reference in its entirety, discloses a device for controlling and adjusting a display light for a retail display such as a freezer, where product are scanned prior to placement into the freezer. The levels and colors of light illuminating the scanned product are adjusted in accordance with stored information for that product by performing a table look-up.

There is a need for improved systems and methods for easier interaction and control of illumination conditions, such as selecting desired light attributes as well as copy and paste operations to provide a desired illumination at a new location (paste) that matches illumination at another location (copy).

One object of the present systems and methods is to overcome the disadvantages of the prior art and provide improved controls in providing a desired illumination.

This and other objects are achieved by systems and methods that include a first controllable light source configured to provide a first light for illuminating a first location, and a second controllable light source configured to provide a second light for illuminating a second location. A detector is configured to receive the first light and measure first light attributes of the first light. A memory is provided for storing a database that includes specification of the second controllable light source, and/or operating parameters of first controllable light source for providing the first light. A processor receives the first light attributes, and in conjunction with the specification of the second controllable light source, controls the second light source to provide the second light having second light attributes at the second location that substantially match the first light attributes of the first light illuminating the first location.

One of the applications includes selecting a certain type of illumination, in terms of intensity and color (i.e., copy operation), and reproducing this illumination at another point (i.e., paste operation). This is a copy and paste operation for the illumination. In principle, a copy and paste operation is based on illumination transfer measurements between light sources and a sensor(s) at both the "copy" and at the "paste" positions. Illustratively, one sensor detects first light source(s) providing illumination at a first location, and light attributes of the light illuminating the first location. The sensor may also detect or receive from the light sources their operating parameters as part of the copy operation. The sensor may be portable and moved to a second location illuminated by second light source(s), identifies the second light source(s) and in conjunction with a system controller, the second light source(s) are controlled to provide light for illuminating the second location having light attributes that substantially match the light attributes illuminating the first location; i.e., paste operation.

The copy and paste operations include a control process where adjustments of light attributes, such as color, intensity and the like, are made to provide a desired illumination and transfer thereof, where neighboring reflections and additional light sources are also taken into account. A good initial estimate to the drive conditions of light sources improves the reliability and increases the speed of the paste operation drastically. Such an improvement may be achieved using light-wave identification and a database in an electronic controller or processor storing the drive conditions and specification of the light sources.

Further areas of applicability of the present systems and methods will become apparent from the detailed description provided hereinafter. It should be understood that the detailed description and specific examples, while indicating exemplary embodiments of the systems and methods, are intended for purposes of illustration only and are not intended to limit the scope of the invention.

These and other features, aspects, and advantages of the apparatus and methods of the present invention will become better understood from the following description, appended claims, and accompanying drawing where:

The following description of certain exemplary embodiment(s) is merely exemplary in nature and is in no way intended to limit the invention, its application, or uses. In the following detailed description of embodiments of the present system, reference is made to the accompanying drawings which form a part hereof, and in which are shown by way of illustration specific embodiments in which the described systems and methods may be practiced. These embodiments are described in sufficient detail to enable those skilled in the art to practice the presently disclosed system and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

Figure 1:
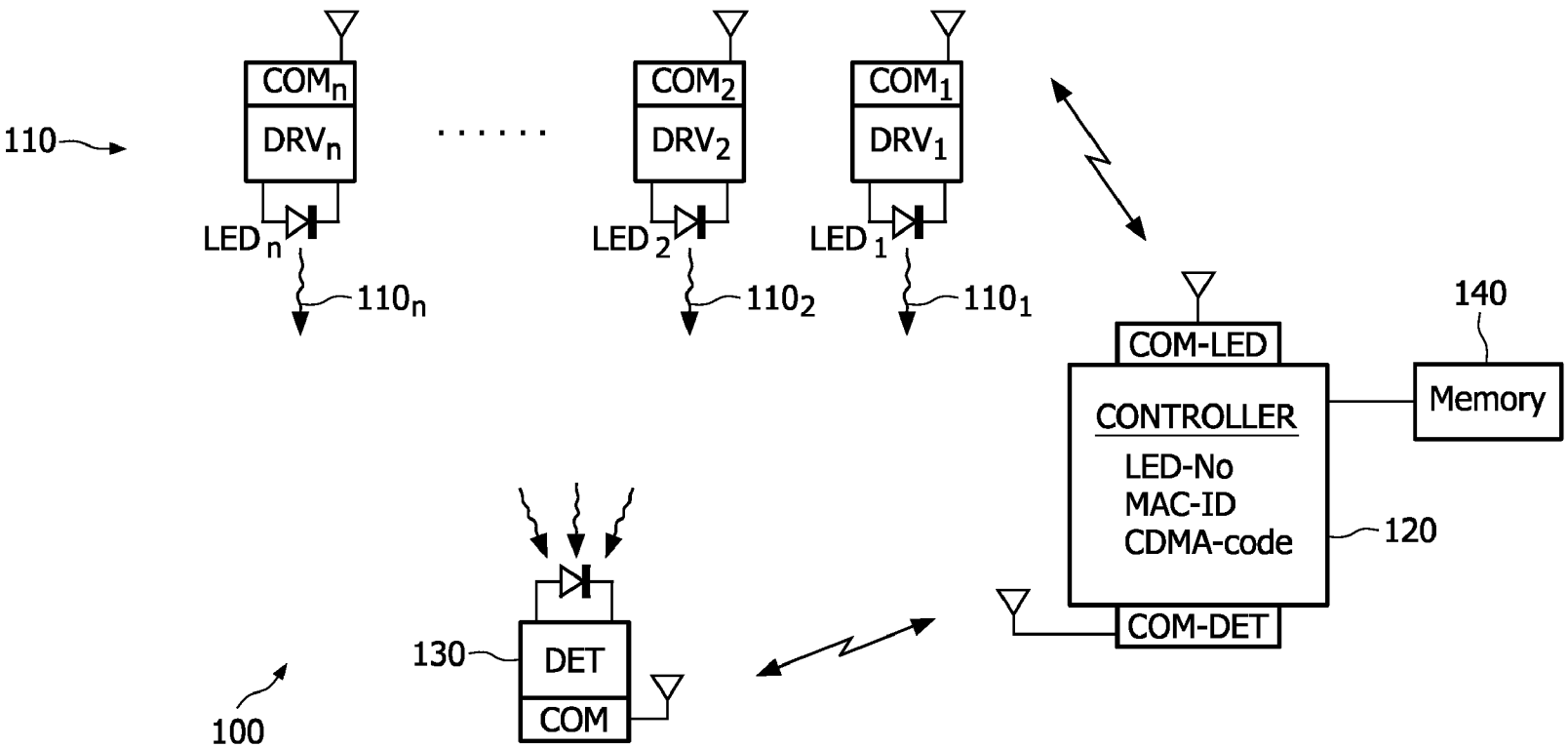
FIG. 1 shows a lighting system according to one embodiment.

FIG. 1 shows a lighting system 100 according to one embodiment including controllable light sources such as solid state lights e.g., light emitting diode LEDs 110, also shown as $L_1$, $L_2$ to $L_n$ and designated reference numerals $\mathbf{110}_1$, $\mathbf{110}_2$ to $\mathbf{110}_n$. Each LED (or group/set of LEDs) 110 has its own drive electronics $DRV_1$, $DRV_2$ to $DRV_n$ for driving and controlling the associated LED. Further each LED has communication means $COM_1$, $COM_2$ to $COM_n$ which may be wired or wireless, for communicating with a system controller or processor 120 and/or other elements, such as detectors, one of which is shown in FIG. 1 and reference as numeral 130. The system controller 120 and/or detector(s) 130 also have communication means, wired or wireless. As is well known, communication means include a transmitter and receiver (or transceiver), filters, modulators and demodulators, converters etc. As would be understood by those skilled in the art, although two communication systems are shown associated with the system controller 120, one for communicating with the LEDs 110 and another for communication with the detector 130, the two communication systems may be integrated into a single communication system.

In the case of radio frequency (RF) wireless communication for example, antennas may be provided for reception and transmission of RF signals. Of course, any communication means capable of communicating desired information may be used, such as using infrared or sonar signals, using any communication protocol, configured for long or short distances such as Bluetooth or Zigbee. Illustratively the short range Zigbee protocol is used.

Figure 3:
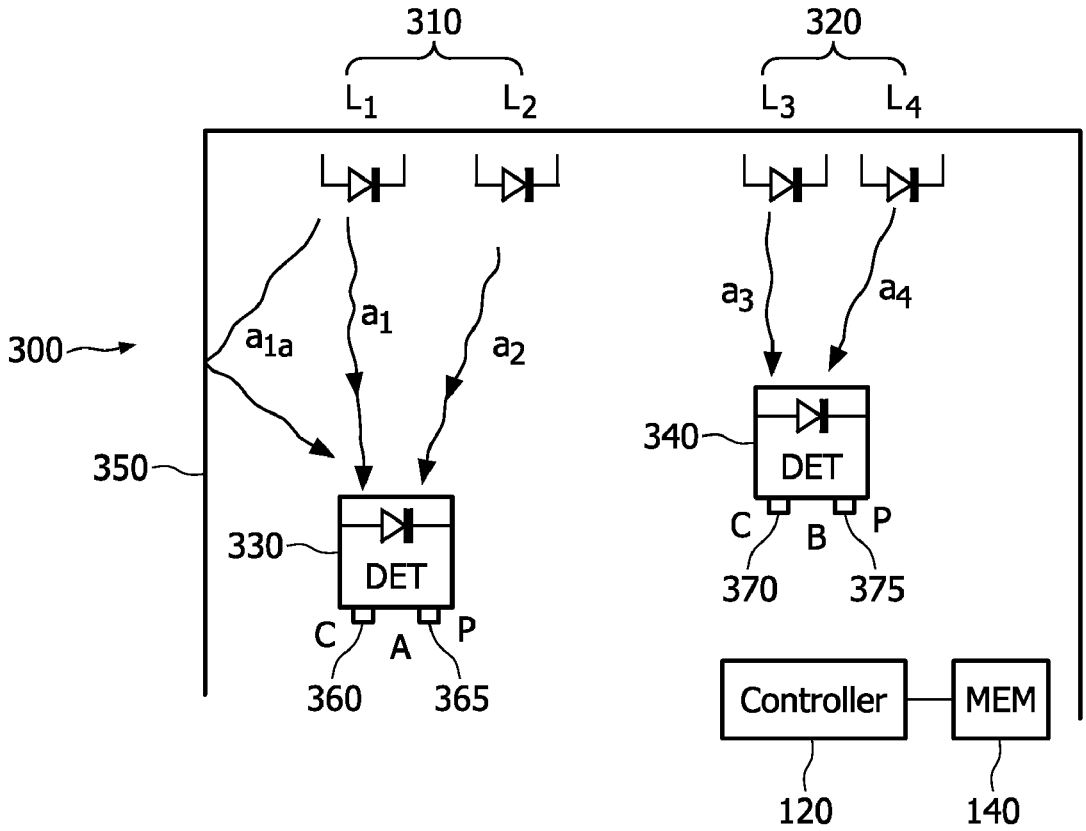
FIG. 3 shows lights sources illuminating two spots according to another embodiment.

The lighting system 100 may be configured such that illumination attributes, e.g., color, intensity, hue, saturation etc., at a given spot, e.g., spot A shown in FIG. 3, may be "copied and pasted" to another spot B in the field of illumination using one or multiple detectors in conjunction with the system controller 120. In the case of a single detector 130, after performing a copy operation at the first spot A, the detector is moved to the second spot B and a past operation is performed. In the case of more than one detector, for example, the copy operation is performed by a first detector 330 at the first spot A, and the past operation is performed a second detector 340 at the second spot B.

Illustratively, spread spectrum coded light source (e.g., LED) identification may be used together with a database containing the matching specifications and drive conditions of the light sources. The database may be stored in a memory 140 of the system controller 120. Alternatively, the database is stored remotely and is accessible to the system controller 110.

In the copy operation, the system controller or processor 120 saves the light-wave code in the database together with the specification and matching operating parameters of the light source illuminating the first spot A (e.g., LEDs $L_1$ and $L_2$ shown in FIG. 3), such as drive current, color, duty cycle, intensity, efficiency, etc.

In the paste operation, these parameters, after device (e.g., LED 110 and/or detector DET 130) and distance dependent corrections, are used in the new spot B to set the initial drive conditions on a new set of light sources, e.g., LEDs $L_3$ and $L_4$. These drive conditions or operating parameters provide an initial estimate towards obtaining the same illumination at the new spot B shown in FIG. 3. Additional control iterations may be used to fine-tune the paste. Of course it should be understand that although two LEDs are shown illumination spots A and B, any number of LEDs may illuminate the spots. The number and type of LEDs at spots A and B need not be the same, and different types of LEDs may also illuminate a single spot.

Figure 2:
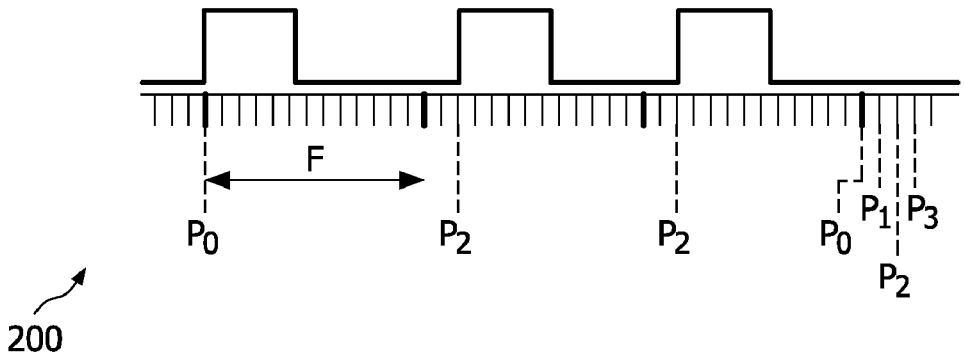
FIG. 2 shows a modulated signal according to another embodiment.

The LEDs 110 may be colored, e.g., red, green and/or blue (RGB), or white LEDs. Each LED or set of LEDs has its own identifier LED-number which indicates the product type, e.g., model or part number, of the LED and DRV electronics. The LED-number indicates or is associated with the specification to provide information, such as the color, light vs. current, respective driver characteristics etc, of a specific LED 110. The DRV electronics is configured to modulate the pulsed operation of an LED, for example, by spread spectrum Code Division Multiple Access (CDMA) codes with Pulse-Position Modulation (PPM) as shown in FIG. 2, or by Time Division Multiple Access (TDMA) based identifier codes. Of course any other type of coding methods may be used that provides the desired information.

Illustratively, FIG. 2 shows a signal 200 having PPM modulated CDMA (spread spectrum) code 011, where the code values are mapped into positions $p_0$, $p_1$, $p_2$, $p_3$, etc., of the pulse in each frame F. In particular, the first pulse at position $p_0$ in the first frame corresponds to code 0, while the second and third pulses at position $p_2$ in the second and third frames corresponds to code 1. Thus, the three pulses shown in FIG. 2 correspond to code 011.

The system controller 120 may be a centralized as shown in FIG. 1, or may be a distributed electronic system. The system controller 120 is configured to provide the basic computation and communication needs of the whole network. It stores in memory 140 the necessary parameters of the LEDs and DRV electronics in order to obtain a desired output from a given set of LEDs. Further, the system controller 120 communicates with the LED/DRV 110 and DET 130 by communication links, which may be, for example, ZigBee links. Each LED (or set of LEDs) has its unique identification (ID) code, e.g., a CDMA code (as shown in FIG. 2), or may be assigned such an ID code by the system controller 120, e.g., upon initialization such as upon adding a new LED to the lighting system 100, at which time for example, the specification of the LED is also stored in the database, and matched or associated with the LED's ID code.

Illustratively, the LED-number includes the LED model or part number so that the specification associated with such a model or part number may be obtained and included in the database stored in the memory 140. The LED/DRV the specification may be provided by the LED/DRV 110 itself. Alternatively or in addition, the system controller 120 may be configured to fetch and/or update the LED/DRV the specification, knowing the model or part number, and downloaded it from a local or wide area network, such as the Internet for example.

The LEDs 110 may be colored, e.g., red, green and/or blue (RGB), or white LEDs. Each LED or set of LEDs has its own identifier LED-number which indicates the product type, e.g., model or part number, of the LED and DRV electronics. The LED-number provides or is associated with the specification, such as the color, light vs. current, respective driver characteristics etc, of a specific LED 110.

The database stored in the memory 140, for example, or stored remotely and being accessible to the system controller 120, includes information used by the system controller 120 to match the CDMA code (or TDMA or other codes) to LED-number, and therefore to determine the specification as well as the operating parameters of an LED as provided by the LED itself, such as color, light intensity, current, duty cycle etc. Further, the system controller 120 also receives from the DET 130 measured illumination parameters of light detected by the DET 130 at its location. The measured illumination parameters are associated with the operating parameters of the particular LED(s) illuminating the location of the DET 130. The data in the database provides a fast initial estimate for the paste operation for new LEDs as described below, where either the DET 130 is moved to a second spot B (FIG. 3) for the past operation or a second DET 340 (FIG. 3) is provided as the second spot B for performing the paste operation.

Illustratively, DET 130 is a hand held device, which is used to detect light originating from the LED(s) at various positions in the illuminated volume, where illumination parameters are copies from the first spot A, the DET moved to the second spot B and then the paste operations performed. For example, the DET 130 is with a photo detector such as a silicon (Si) photo-diode with no color filters. Of course, a color photo-diode may also be used to further detect color of the illumination. The DET detection circuit 130 is configured to identify the CDMA code of an LED, shown in FIG. 2, directly from its illumination light output. The correlated output of the DET 130 provides a relative peak intensity measurement of the light impinging thereon.

Thus, the DET 130 located at an illumination spot is configured to detect the unique identification (ID) of an LED (or set of LEDs) from the LED's own light output illuminating the illumination spot. Further, the DET 130 measures illuminations parameters at its location, i.e., at the illumination spot, such as intensity, color, hue, saturation etc., for example. The DET 130 communicates to the system controller 120 the LED ID and the measured illuminations parameters of the light illuminating the illumination spot. In addition, the operating parameters of the LED, e.g., drive conditions such as current, voltage, duty cycle, color, etc., may also be transmitted by the LED to the system controller 120, and/or to the DET 130 which, in turn, the DET 130 may transmit the LED operating parameters to the system controller 120.

The transmissions of the spot measured illuminations parameters and LED operating parameters may be performed upon query from the system controller 120 (and/or upon query from the DET 130) for example, such as when copy and paste operations are initiated by a user, or may be automatically transmitted upon a change in illumination parameters and/or operating conditions, such as turning on the LED(s), adjusting its parameters by the user, or illumination changes at the illumination spot, and/or LED operating parameters, due to environmental changes such as heat, humidity. Such environmental changes may affect the measured illuminations parameters including changes in the light path from the LED to the illumination spot, where a direct path may be obstructed, changes occur to the indirect path including reflection(s) from wall(s) or other surfaces resulting in a change in illumination at the illumination spot, and this changes in the illuminations parameters is measured or detected by the DET 130.

Based on the LED operating parameters, the measured illuminations parameters and the identified LED's specification included in the database, the LED(s) and/or other LEDs are controlled by the system controller 120, such as to provide a desired illumination at desired spots, including performing copy and paste operations. As noted, the controller database, e.g., stored in the memory 140, may be created by matching the LED light-wave codes to LED operating parameters or conditions, and/or the LED's specifications, in order to reproduce the same illumination at a new spot when effectuating copy and paste operations.

Illumination Parameters:

For illustration purposes, consider the case of square LED pulses as shown in FIG. 2. In order to obtain such a light output, a certain bias is provided across the LED diode, e.g., provided by voltage and current pulses with peak values V and I, respectively. In such a case, the peak light output of the LED pulses is given by:

$$L_p = eIV$$

where e is the quantum efficiency of the diode.

The integrated light pulse output of the diode is given by:

$$L_i = dL_p = deIV$$

where d is the duty cycle of the LED.

These intensity parameters are the light outputs generated at the LED devices themselves. The corresponding measured light at the photodiodes DET 130 has to take into account the distances of the LEDs to the photodiode DET 130. The measured intensities at the illumination spot, measured by the DET 130, are also weighed with the distance dependent attenuation parameters "a". With these latter corrections, the measured light intensities become:

$$L_{pm} = aeIV$$

and $$L_{im} = adeIV$$

FIG. 3 shows light outputs of LEDs hitting photo detector surfaces at the two different spots in the illumination region. As shown in FIG. 3, a lighting system 300 includes four light sources, such as LEDs, where a pair 310 of LEDs $L_1$, $L_2$ illuminates spot or location A that includes a detector 330, and another pair 320 of LEDs $L_3$, $L_4$ illuminates another spot or location B that includes another detector 340. Of course, any number of LEDs or sets of LEDs may be provided to illuminate the illumination spots A and/or B.

Light rays from the first pair of LEDs $L_1$, $L_2$ that are incident on the first detector 330 at location A, include the effects of reflections from surfaces, such as from a wall 350. Typically, most surfaces have broad reflection spectra that does not substantially affect or change the color of illumination. Similarly, Light rays from the second pair of LEDs $L_3$, $L_4$ are incident on the second detector 340 at location B. The light measured in the first spot A is reproduced at the second spot B by copy and paste operations, for example, by equating the light generated at the LEDs with corrections for the LED types and distance variations of the two different spots A, B. Of course, light measurements at spot A and/or spot B, and associated LED operating parameters that provide such illumination, may also be taken into account.

Assume, for example, that LEDs $L_1$ and $L_3$ are both red LEDs (which would be known/knowable by the system controller 120 as the LED specifications, matched to the particular LEDs $L_1$, $L_3$, are included in the database stored in the memory 140), and that it is desired to reproduce at illumination spot B (illuminated by LEDs $L_3$) the integrated illumination of $L_1$ at illumination spot A. The following relationship/equality includes the effects of duty cycles, and from the equality of the measured integrated intensities we get:

$$(a_{1a}+a_1)e_1d_1I_1V_1 = a_3e_3d_3I_3V_3$$

where d, I, V are the duty cycle, current and voltage or respective LEDs $L_1$ and $L_3$, and "a" is the distance dependent attenuation parameter of direct or indirect (e.g., reflected from wall 350 for $a_{1a}$) of light emitted from the LEDs $L_1$ and $L_3$ illuminating spots A and B, respectively.

In a system with similar LEDs, which is the typically the case for a room where copy and paste operation is desired, the peak light output of LED $L_3$ will be substantially equal to the peak light output of LED $L_1$ as shown by:

$$e_3I_3V_3 = e_1I_1V_1$$

Thus, the distance dependent measurement of peak intensities will give the ratio $R_m$ as follows:

$$R_m = [(a_{1a}+a_1)e_1I_1V_1]/[a_3e_3I_3V_3] = (a_{1a}+a_1)/a_3$$

The ratio $R_m$ is dependent on the distances of the detectors 330, 340 at the points A and B from the respective LEDs $L_1$ and $L_3$. For a Pulse-Width Modulation (PWM) case, which is commonly used to drive LEDs, for example, the duty cycles $d_1$, $d_3$ of the LEDs $L_1$, $L_3$ are adjusted to effectuate the copy and paste operation by using:

$$d_3=d_1R_m=d_1(a_{1a}+a_1)/a_3$$

As is well known, Pulse-Width Modulation of a signal or power source involves the modulation of its duty cycle, to either convey information over a communications channel or control the amount of power sent to a load.

In summary, the copy and paste operations automatically compensate for the distance dependent variations in order to obtain similar light attributes, such as similar color compositions and/or intensities, at two different spots A, B.

Of course, instead of the above described open loop control, a closed loop iterative control may be performed, expressed as $d_3=d_3(1+\alpha)$, with the convergence parameter $\alpha>0$, if the measured illumination parameters at location A are greater than the illumination parameters measured at location B.

It should be noted that it is also possible to adjust the driving bias conditions (e.g., current and/or voltage values IV) of the LEDs to achieve illumination equality at the two spots A, B. In other words, the peak intensity ratio, $R_m$, may be compensated by adjusting the duty cycle "d" and/or the driving bias conditions, such as LED drive current "I" and/or voltage "V" values.

Network Initialization Operations:

In order to assure fast and efficient operation of the copy and paste, the following preparations may be performed in the network during the initial setup time:

In the system controller 120, the MAC-ID of the ZigBee Protocol, for example, is matched to each LED/DRV unit 110 with product specifications, such as the LED-number which may be associated with the product type, e.g., model or part number.

Using the COM-LED ZigBee link, for example, a spread-spectrum CDMA-code is assign to each of the LED/DRV 110. It should be noted that each MAC-ID is matched to a CDMA code uniquely. In this way, once the CDMA code is known and a particular LED is identified, the system controller 120 can find out, through lookup in the database stored in memory 140 and/or querying the particular LED, the specifications (such as nominal, maximum and minimum values of recommended operating parameters and associated expected light output, color, etc.) and current/voltage/duty cycle or nominal operating parameters including color and other specification/data of the particular LED identified by the CDMA code, for example.

The results of the above initialization operations are stored in the database accessible to the system controller 120, such in the memory 140, to be used during the copy and paste operation. Of course, needed data, such as specification of the identified LEDs need not be stored locally, and may be stored remotely and retrieved as needed or cached into a cache memory. Illustratively, from the LED-number indicating type, model or part number, the controller 120 may be configured to access a local or wide area network, such as the Internet, and download the specification of the identified LED, or updates thereof, and store such updates, specification or other desired data, either in cache or in a more permanent memory, such as the memory 140.

Copy Operations:

As an illustrative example, assume that a user is at spot A shown in FIG. 3 illuminated by LEDs $L_1$, $L_2$, where DET 330 measures light attributes received from at least one of the LEDs $L_1$, $L_2$, or combinations thereof. It is desired to repeat the illumination attributes, e.g., color, intensity, hue and/or saturation of light illuminating spot A elsewhere, such as at spot B. For the copy operation, the following acts may be performed:

C1—Push a "Copy" button "C" 360 on the DET 330 located at spot A and receiving illumination form one or a combination of LEDs $L_1$, $L_2$. Identify the CDMA-code of the LEDs $L_1$, $L_2$ contributing to the illumination at spot A by using the detected light by the DET unit 330. As shown in FIG. 3, the DET 330 may also include a Paste "P" button 365. Further, record the peak intensities or relative peak intensities of the LEDs $L_1$, $L_2$ identified from the CDMA-codes (e.g., shown in FIG. 2) included in the illumination or other signals emitted by the LEDs $L_1$, $L_2$ and detected by the DET 330 at spot A. Send this data to the system controller 120.

C2—Using the database accessible (e.g., stored in memory 140) by the system controller 120, find out the MAC-IDs for example, and communicate to the LED/DRV units $L_1$, $L_2$, in order to find out the current operating parameters, such as color, current and duty cycle of the LEDs corresponding to the detected CDMA-codes from spot A.

Paste Operations:

Move to a spot B where it is desired to reproduce the illumination of spot A. For the paste operation the following acts may be executed. As noted, the same detector that performed the copy operation at illumination spot A may be moved to spot B for performing paste operations. Alternatively, a second detector DET 340 may be used to perform the past operations at the new spot B.

P1—Push the "Paste" button "P" 375 on the DET unit 340 located at spot B. Turn all lights or LEDs $L_3$, $L_4$ at spot B to an on state with the smallest duty cycle available, for example. The DET 340 may also include a Copy "C" button 370. Identify the CDMA-code of the LEDs $L_3$, $L_4$ contributing to the illumination at spot B by using the detected light in DET unit 340 located at spot B. Send this data to the system controller 120 and find the specification of the identified LEDs $L_3$, $L_4$ illuminating spot B, as well as their current operating parameters, such as type, color, intensity, drive characteristics, duty cycle etc.

P2—Perform a mapping of the LEDs from spot A to spot B by taking the current operating parameters of the LEDs $L_1$, $L_2$ from spot A, such as colors etc., as tabulated in the database associated with the system controller 120, such as stored in memory 140.

P3—To the LEDs mapped in spot B, apply the operating parameters, such as current, voltage and duty cycle driving conditions of the LEDs $L_1$, $L_2$ illuminating spot A as stored in the database from step C2. Next, record the (relative) peak intensities of the LEDs $L_3$, $L_4$ in spot B, measured by the DET unit 340, and send this data to the system controller 120.

Step P4—Using the relative peak intensities of the LEDs included in the controller's database stored in memory 140, from steps C1 and P3, calculate the distance dependent correction ratios $R_m$. Next, use these ratios to calculate new duty cycles for LEDs $L_3$, $L_4$ at spot B.

It should be noted that, in step P3, if the drive limitations of one or a certain number of LEDs at spot B are reached, as determined from the current operating parameters communicated from the LED at spot B to the system controller 120, and yet the desired illumination is not yet achieved, a new LED(s) with the same color may be needed/activated to provide the desired illumination characteristics at spot B. Such determination of drive limitations may be achieved by comparing the current LED operating parameters with the LED specification included in the database and stored in the memory 140, for example. This is analogous to the case where there is much smaller number of LEDs (step P2) at spot in B as compared to spot A. In such a case, the copy and paste operations may include activation of additional LEDs to illuminate spot B. For example, additional LEDs may be activated and controlled to direct light having desired attributed toward spot B to achieve the past operation so that the illumination at spot B substantially matches the 'copied' illumination from spot A.

A further case requiring attention and associated adjustments includes having different LEDs with different specification at different spots. In this case, the driving conditions of the LEDs at the 'paste' spot B may be adjusted to have values different from the operating parameters of the different LEDs at the 'copy' spot A. Of course, such operating parameter adjustments of the LED's at the 'paste' spot B are also corrected, as described, for distance (between the illumination LEDs and the illuminated spot B) and for reflected/indirect illumination of the spot B.

As would be apparent to those skilled in the art in view of the description herein, various other communication links, instead of the ZigBee link, may be used such as light-wave, infrared (IR), sonar or other links for communication and control among the various system elements, and to operationally couple the various system elements to each other, such as among the LED/DRV units 110, DET units 130, 330, 340 and the system controller 120. In the case of light-wave communication links, photo diodes may be provided.

A combination of various links may also be used. For example, the LED/DRV units 110 may be provided with photo diodes, the DET units may include IR emitters to determine the selection of the LEDs 110, which see the IR illumination field of view. Then, for example, only those LEDs in the IR illumination field of view turn on to identify themselves.

A color photo detector may also be used in stead of or in conjunction with the DET units to take into account the effects of non-coded light sources and color changing reflections. In such cases, iterative corrections may be provided. A rake receiver structure may also be used to measure the duty cycle at the DET unit directly, rather than requesting (e.g., by the system controller 120 and/or the DET unit 130) the duty cycle and other LED operating parameters from the LED/DRV unit(s) 110. Further, different type diodes can be handled by different correction factors with a procedure similar to the one described in the "illumination parameters" section above.

Various modifications may also be provided as recognized by those skilled in the art in view of the description herein. For example, the copy and paste buttons 360, 365 shown in FIG. 3 may be integrated into one button, where the DET unit 330 is switchable to different modes, e.g., the copy and paste modes, or copy and paste button(s) are located on other devices including the system controller 120, for example. The buttons may be software buttons displayed on a display associated with any of the system components, such as associated with the DET unit(s) and/or the system controller, where a pointing device such as a mouse, keyboard or any other suitable input/output (I/O) device, such as a pointer in the case of touch sensitive displays, where the pointer may be used to activate the software button(s) displayed on the touch sensitive display or monitor, which may be a stand alone display connectable or operationally coupled to the system controller 120. Of course, any type of display may be used, such as a liquid crystal display (LCD), a plasma display, or a cathode ray tube (CRT). Further, multiple displays may be provided, which may be part of a different system, such as a multimedia system or a television set, for display of desired information, such as information retrieved from the memory 140 or downloaded from the Internet or other local or wide area networks.

The light sources need not be LEDs and may be any controllable light source capable of providing lights of various attributes, such as various intensity levels, different colors, hue, saturation and the like, such as incandescent, fluorescent, halogen, or high intensity discharge (HID) light, which may have a ballast for control of the various light attributes. However, LEDs are particularly well suited light sources as they easily can be configured to provide light with changing colors, intensity, hue, saturation and other attributes, and typically have electronic drive circuitry for control and adjustment of the various light attributes.

The various component of the system may be operationally coupled to each other by any type of link, including wired or wireless link(s), for example. Further, the DET 130 and/or system controller 120 may be portable units, and may be part of, or incorporated into a remote controller, a personal digital assistant (PDA), mobile phone, and/or laptop or personal computer.

The memory 140 may be any type of device for storing application data as well as other data. The application data and other signals or data are received by the system controller or processor 120 for configuring it to perform operation acts in accordance with the present systems and methods.

The operation acts of the present methods are particularly suited to be carried out by a computer software program, such computer software program preferably containing modules corresponding to the individual steps or acts of the methods. Such software can of course be embodied in a computer-readable medium, such as an integrated chip, a peripheral device or memory, such as the memory 140 or other memory coupled to the system controller or processor 120.

The computer-readable medium and/or memory 140 may be any recordable medium (e.g., RAM, ROM, removable memory, CD-ROM, hard drives, DVD, floppy disks or memory cards) or may be a transmission medium (e.g., a network comprising fiber-optics, the world-wide web, cables, and/or a wireless channel using, for example, time-division multiple access, code-division multiple access, or other wireless communication systems). Any medium known or developed that can store information suitable for use with a computer system may be used as the computer-readable medium and/or memory 140.

Additional memories may also be used. The computer-readable medium, the memory 140, and/or any other memories may be long-term, short-term, or a combination of long- and short-term memories. These memories configure the processor 120 to implement the methods, operational acts, and functions disclosed herein. The memories may be distributed or local and the processor 120, where additional processors may be provided, may be distributed or singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network is still within memory 140, for instance, because the processor 120 may retrieve the information from the network.

The processor 120 and memory 140 may be any type of processor/controller and memory, such as those described in U.S. 2003/0057887, which is incorporated herein by reference in its entirety. The processor 120 is capable of providing control signals and/or performing operations in response to input signals from the DET unit 130 and/or the light source(s) 110, and executing instructions stored in the memory 140. The processor 120 may be an application-specific or general-use integrated circuit(s). Further, the processor 120 may be a dedicated processor for performing in accordance with the present system or may be a general-purpose processor wherein only one of many functions operates for performing in accordance with the present system. The processor may operate utilizing a program portion, multiple program segments, or may be a hardware device utilizing a dedicated or multi-purpose integrated circuit. Each of the above systems utilized for identifying the presence and identity of the user may be utilized in conjunction with further systems.

Of course, it is to be appreciated that any one of the above embodiments or processes may be combined with one or with one or more other embodiments or processes to provide even further improvements in finding and matching users with particular personalities, and providing relevant recommendations.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;
b) the word "a" or "an" preceding an element does not exclude the presence of a plurality of such elements;
c) any reference signs in the claims do not limit their scope;
d) several "means" may be represented by the same item or hardware or software implemented structure or function;
e) any of the disclosed elements may be comprised of hardware portions (e.g., including discrete and integrated electronic circuitry), software portions (e.g., computer programming), and any combination thereof;
f) hardware portions may be comprised of one or both of analog and digital portions;
g) any of the disclosed devices or portions thereof may be combined together or separated into further portions unless specifically stated otherwise; and
h) no specific sequence of acts or steps is intended to be required unless specifically indicated.

The invention claimed is:

1. A lighting system comprising:

a first controllable light source generating a first light;

a second controllable light source generating a second light;

a first detector configured to receive at least a portion of the first light and measure at least one attribute thereof in a first predetermined location proximate to the first controllable light source;

a memory configured to store at least one of an operating specification of the second controllable light source and at least one operating parameter of the first controllable light source;

a processor configured to receive said at least one attribute of said first light, based at least in part on the received at least one attribute of said first light and said operating specification of said second controllable light source, control said second controllable light source to generate said second light, wherein said processor is operable to map said at least one operating parameter of said first controllable light to said operating specification of said second controllable light to determine an initial setting for said second controllable light;

said initial setting for second light has at least one second light attribute that substantially matches said at least one first light attribute of the first light in a predetermined second location proximate to the second controllable light source.

2. The lighting system of claim 1, further comprising a second detector configured to receive at least a portion of the second light and measure the at least one attribute thereof.

3. The lighting system of claim 1, wherein the memory is further configured to store at least one of a specification of the first controllable light source and at least one operating parameter of the second controllable light source.

4. The lighting system of claim 1, wherein the first detector is further configured to identify a type of the first controllable light source based at least in part on a code included in the first light.

5. The lighting system of claim 4, wherein the processor is further configured to fetch a specification of the first controllable light source based on the type.

6. The lighting system of claim 1, wherein the processor is configured to receive at least one of a first code included in the first light and a second code included in the second light from at least one of the first detector, the first controllable light source and the second controllable light source.

7. The lighting system of claim 6, wherein the first detector is movable between the first predetermined location and the second predetermined location for detecting the first code and the second code.

8. The lighting system of claim 1, wherein the processor is further configured to query the second controllable light source, and to receive identifying information of the second controllable light source in response to the query for fetching the specification of the second controllable light source using the identifying information.

9. The system (100) of claim 1, wherein the processor is further configured to adjust an operating parameter of the second controllable light source to compensate for variations of the second light due to a distance of the second controllable light source from the second location.

10. The lighting system of claim 1, wherein the at least one operating parameter of the first controllable light source is provided to the processor from the first controllable light source upon request from the processor.

11. The lighting system of claim 10, wherein the processor is configured to apply the at least one operating parameter to the second controllable light source.

12. A method of controlling a lighting system comprising a first light source illuminating a first location with a first light and a second light source illuminating a second location with a second light, the method comprising the acts of:

measuring at least one attribute of the first light;

storing a database including at least one of a specification of the second light source, and at least one operating parameter of the first light source; and controlling the second light source based at least in part on the at least one attribute of the first light and the at least one of the stored specification of the second controllable light source and the at least one operation parameter of the first light source to provide the second light having at least one attribute of the first light; and adjusting at least one operating parameter of the second light source to compensate for variations between the at least one attribute of the second light and the at least one attribute of the first light due to a distance of the second light source from the second location.

13. The method of claim 12, wherein the database further includes at least one of a specification of the first light source and one or more operating parameters of the second light source for providing the second light.

14. The method of claim 12, further comprising the act of identifying a type of the first light source from a code included in the first light.

15. The method of claim 14, further comprising the act of fetching a specification of the first light source based on the type.

16. The method of claim 12, further comprising the acts of:

receiving identifying information of the second light source; and fetching the specification of the second light source using the identifying information.

17. The method of claim 12, further comprising the act of applying the at least one operating parameter of the first light source to the second light source.

18. The method of claim 12, further comprising the acts of:

detecting a first code included in the first light by a detector;

moving the detector to the second location;

detecting a second code included in the second light by the detector (330); and providing at least one of the first code and the second code to a controller.

19. A lighting system comprising:

a first controllable light source generating a first light;

a second controllable light source generating a second light;

a detector configured to receive said first light and measure a first light source controllable attribute in a first predetermined location proximate to the first controllable light source;

a memory having stored records representative of operating drive specification data for said second controllable light source;

said memory further having stored records representative of operating drive specification data for said first controllable light source representative of said at least one attribute of said first light;

a processor configured to receive said at least one attribute of said first light based at least in part on said received at least one attribute of said first light and said drive specification data of said second controllable light source;

configure said processor to control said second controllable light source to generate said second light, wherein said processor is operable to map said operating drive specification data for said first controllable light to said operating drive specification of said second controllable light to determine a first initial setting for said second controllable light;

said first initial setting for said second controllable light source including a second light attribute that substantially matches said first light source controllable attribute of said first light;

said processor further operable to modify said first initial setting for said second controllable light source to calculate distance dependent correction ratio to generate a second initial setting for said second light different than said first initial setting.

* * * * *